US008070109B2

(12) United States Patent
Zahornacky et al.

(10) Patent No.: US 8,070,109 B2
(45) Date of Patent: Dec. 6, 2011

(54) SYSTEM AND METHOD FOR CONTROLLING A BELL IN A MODEL VEHICLE

(75) Inventors: Jon F. Zahornacky, Santa Clara, CA (US); James M. Rohde, Walled Lake, MI (US); Tyler R. Brooks, Dearborn, MI (US)

(73) Assignee: Lionel L.L.C., Chesterfield, MI (US)

( * ) Notice: Subject to any disclaimer, the term of this patent is extended or adjusted under 35 U.S.C. 154(b) by 250 days.

(21) Appl. No.: 12/534,021

(22) Filed: Jul. 31, 2009

(65) Prior Publication Data

US 2011/0024577 A1 Feb. 3, 2011

(51) Int. Cl.
*A63H 19/34* (2006.01)
*B60L 1/00* (2006.01)

(52) U.S. Cl. ..... 246/473 A; 104/296

(58) Field of Classification Search ..... 246/122 R, 246/122 A, 167 R, 473 R, 473 A; 446/175, 446/397, 408–410; 105/1.4, 1.5, 29.2; 104/288, 104/295–297
See application file for complete search history.

(56) References Cited

U.S. PATENT DOCUMENTS 1,684,754 A * 9/1928 Becker ..... 246/72
3,641,466 A * 2/1972 Ernst ..... 335/190
5,174,216 A * 12/1992 Miller et al. ..... 104/296
6,616,505 B1 * 9/2003 Reagan et al. ..... 446/467
7,429,931 B2 * 9/2008 Severson ..... 340/686.1

* cited by examiner

*Primary Examiner* — Joe Morano, IV
*Assistant Examiner* — R. J. McCarry, Jr.
(74) *Attorney, Agent, or Firm* — O'Melveny & Myers LLP

(57) ABSTRACT

A system and method is provided for controlling bell movement and/or sound in a model train or other model vehicle. In one embodiment of the present invention, the system includes a user control, a sound subsystem, a bell controller and a bell device. The user control may include a lever, a track, and a plurality of predetermined positions on the track, wherein the lever can be moved by a user to any one of the plurality of predetermined positions. The user control may be configured to transmit at least one bell signal in response to the lever being released from (or moved to) one of the plurality of predetermined positions. The bell controller is configured to receive the bell signal, and to use the bell signal to control at least the bell device. The bell device may include a bell and an electromagnetic device, wherein the bell comprises a permanent magnet and is configured to swing from a bracket. By applying at least one voltage to the electromagnetic device, and placing the bell near the electromagnetic device, a magnetic field can be created and used to swing the bell from the bracket, thereby simulating bell movement. The bell controller may further be adapted to synchronize bell movement with bell sound by transmitting a bell sound signal to the sound subsystem at a particular time, so as to substantially synchronize at least one bell movement with at least one bell sound.

20 Claims, 5 Drawing Sheets

SYSTEM AND METHOD FOR CONTROLLING A BELL IN A MODEL VEHICLE

BACKGROUND OF THE INVENTION

1. Field of the Invention

The present invention relates to controlling features in a model vehicle or, more particularly, to a system and method for controlling bell movement and/or bell sound in a model train or other model vehicle.

2. Description of Related Art

User controls for initiating bell sounds in model trains are well known in the art. For example, a user may interact with a user control to produce a bell signal. The bell signal may then be provided to a sound subsystem, where it is used to produce a bell sound. One drawback of such a system, however, is that the bell sound is not synchronized with bell movement. In other words, there is no coordination between producing a bell sound (e.g., "ding"), and swinging a model bell from the model train. Further, to the extent the model bell is moved, it is not moved (or swung) in a realistic fashion. For example, on an actual locomotive, a rope is usually attached to a bell. An engineer pulls the rope to move the bell to an initial starting position. Once the rope is released, the bell will swing from side-to-side, making a bell sound each time the bell strikes a striker.

Thus, it would be advantageous to provide a model vehicle system and method that overcomes at least some of the foregoing drawbacks. For example, such a system may include a bell controller adapted to move a bell, so as to simulate bell movement on an actual locomotive (e.g., by moving a bell to an initial starting position, by allowing the bell to swing from side-to-side in a realistic and decaying fashion, etc.). Such a bell controller may also (or alternately) be adapted to synchronize bell movement to bell sound, so as to simulate bell movement and sound in an actual locomotive.

SUMMARY OF THE INVENTION

The present invention provides a system and method for controlling bell movement and/or sound in a model train or other model vehicle. Preferred embodiments of the present invention operate in accordance with a user control, a sound subsystem, a bell controller and a bell device.

In a first embodiment of the present invention, the user control includes a lever, a track, and a plurality of predetermined positions on the track, wherein the lever is spring loaded and can be moved by a user to any one of the plurality of predetermined positions. In one embodiment, the user control is configured to transmit a bell signal in response to the lever being released from one of the plurality of predetermined positions. In another embodiment, the user control is configured to transmit a bell signal in response to the lever being moved to one of the plurality of predetermined positions. In both embodiments, the bell signal corresponds to the position from which the lever has been released from or moved to, which may correspond to an initial bell position (e.g., 25° from normal, etc.). In yet another embodiment, the user control is configured to transmit a first signal (e.g., a first portion of the bell signal) in response to the lever being moved to a particular position, and transmit a second signal (e.g., a second portion of the bell signal) in response to the lever being released from the particular position. In this embodiment, the first signal corresponds to the position from which the lever has been moved to (e.g., an initial bell position, etc.), and the second signal corresponds to a "trigger" for bell movement and/or bell sound.

In a second embodiment of the present invention, the bell controller is configured to receive the bell signal, and to use the bell signal to control at least the bell device. In this embodiment, the bell device includes at least a bell and at least one electromagnetic device, wherein the bell comprises a permanent magnet and is configured to swing from a bracket, or a pivoting portion thereof. The electromagnetic device may include a spool, a core and a coil, wherein the core is at least partially disposed inside the spool, and the coil is wrapped at least partially around the spool. By applying a voltage to the coil, and placing the core near the permanent magnet, a magnetic field can be created around the core and used to swing the permanent magnet from the bracket, thereby simulating bell movement. In this embodiment, the polarity of the voltage controls the direction that the bell moves, and the magnitude of the voltage controls the distance from normal that the bell moves.

In a third embodiment of the present invention, the bell controller includes a microcontroller, a converter, and an amplifier in communication with the electromagnetic device. The microcontroller is configured to receive the bell signal (e.g., from the user control), and to produce a digital signal in response thereto. The converter is then configured to convert the digital signal into an analog signal, and the amplifier is configured to convert (or amplify) the analog signal into a bell movement signal. In a preferred embodiment of the present invention, the bell movement signal comprises at least one voltage, which is provided to the coil of the electromagnetic device, and used to produce at least one magnetic field.

In a fourth embodiment of the present invention, the bell controller includes a microcontroller and a plurality of switching devices. By controlling each switching device, the microcontroller can provide a bell movement signal (e.g., at least one voltage) to the electromagnetic device.

In a fifth embodiment of the present invention, the bell controller is further configured to synchronize bell movement with bell sound. In one embodiment, the sound subsystem is configured to receive the bell signal from the user control, and to produce a bell sound in response thereto. The bell controller is then configured to transmit the bell movement signal (e.g., at least one voltage) at a particular time, so as to substantially synchronize at least one bell movement with at least one bell sound. In another embodiment, the sound subsystem is configured to receive a bell sound signal (e.g., a single strike bell ring command) from the bell controller, and to produce a bell sound in response thereto. The bell controller is configured to transmit the bell sound signal at a particular time, so as to substantially synchronize at least one bell movement with at least one bell sound.

A more complete understanding of a system and method for controlling bell movement and/or sound in a model vehicle will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method for controlling bell movement and/or sound in a model train or other model vehicle. In the detailed description that follows, like element numerals are used to describe like elements illustrated in one or more figures.

Figure 1:
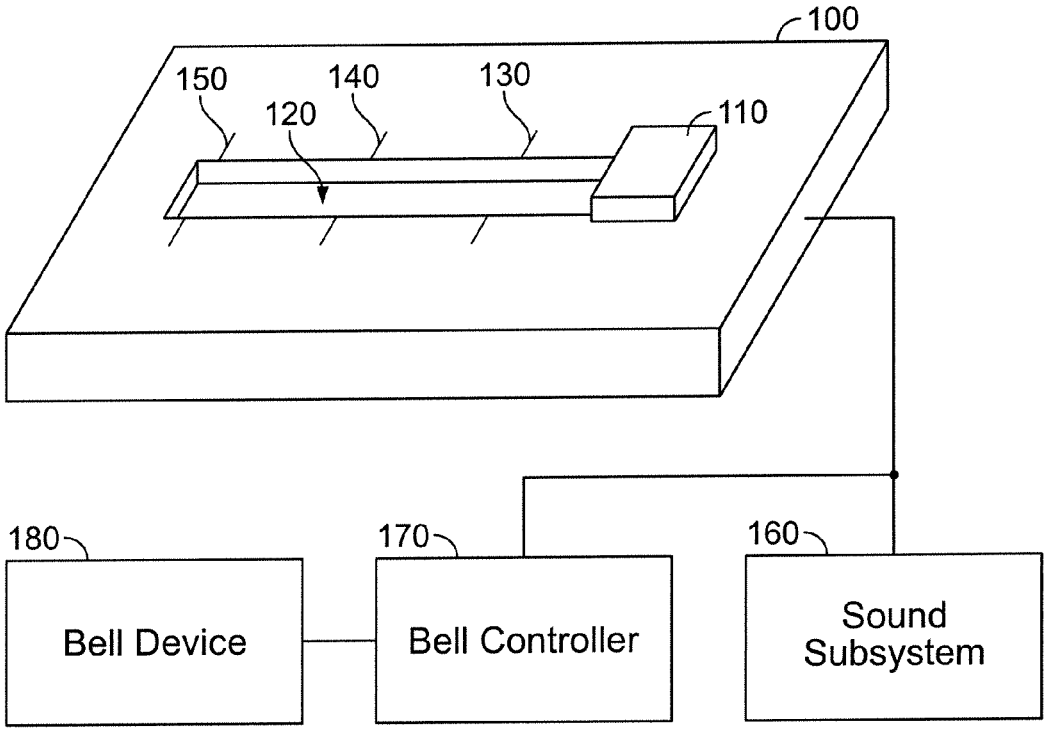
FIG. 1 illustrates a system for controlling bell movement and/or sound in accordance with one embodiment of the present invention, the system comprising at least a user control, a sound subsystem, a bell controller and a bell device.

A system for controlling bell movement and/or sound in accordance with one embodiment of the present invention is shown in FIG. 1. Specifically, the system includes a user control 100, a sound subsystem 160, a bell controller 170, and a bell device 180, wherein a bell signal is transmitted by the user control 100 in response to a user interacting with the user control 100. The bell controller 170 then receives the bell signal and uses it to control the bell device 180 and/or the sound subsystem 160.

In one embodiment of the present invention, the user control 100 includes a lever 110, a track 120, and a plurality of predetermined positions (e.g., 130-150) on the track 120, wherein the lever 110 is spring loaded and can be moved by a user to any one of the plurality of predetermined positions (e.g., 130-150). In a first embodiment of the present invention, the user control 100 is configured to transmit the bell signal in response to the lever 110 being released from one of the plurality of predetermined positions (e.g., 130-150). In a second embodiment of the present invention, the user control 100 is configured to transmit the bell signal in response to the lever 110 being moved to one of the plurality of predetermined positions (e.g., 130-150). In both embodiments, the bell signal corresponds to (or can be used to identify) the position from which the lever 110 has been released from or moved to.

For example, if a first position 130 on the track 120 corresponds to a bell movement of 20° from normal, a second position 140 on the track 120 corresponds to a bell movement of 45° from normal, and a user pulls the lever 110 to (or releases it from) the first position 130, then the user control 110 will transmit a signal (La, bell signal) corresponding to a movement of 20° from normal. If the user then pulls the lever 110 to (or releases it from) the second position 140, then the user control 110 will transmit a signal (i.e., bell signal) corresponding to a movement of 45° from normal. By way of another example, if a third position 150 on the track 120 corresponds to continuous bell movement, and a user pulls the lever 110 to (or releases it from) the third position 150, then the user control 110 will transmit a signal corresponding to continuous movement. In accordance with this example, the bell controller 170 may use such a signal to continuously control (e.g., continuously swing) the bell device 180, without any further user interaction. The bell controller 170 may cease continuously control of the bell device 180 after a predetermined time or in response to a subsequent signal (e.g., from the user control 100, a sensor (not shown), etc.).

In a third embodiment of the present invention, the user control 100 is configured to transmit a first signal in response to the lever 110 being moved to a particular position (e.g., 130), and to transmit a second signal in response to the lever 110 being released from the particular position. For example, if a first position 130 corresponds to a bell movement of 20° from normal, a user moves the lever 110 to the first position 130, and the user releases the lever 110 from the first position 130, then the user control 110 will transmit a first signal (e.g., a first portion of the bell signal) in response to the lever 110 being moved to the first position 130, and transmit a second signal (e.g., a second portion of the bell signal) in response to the lever 110 being released from the first position 130. In this example, the first signal may corresponds to a movement of 20° from normal, and the second signal corresponds to a "trigger" for moving the bell. In other words, the first signal moves the bell to an initial starting position (e.g., 20° from normal), and the second signal releases the bell from the initial starting position (e.g., allowing it to swing). In an alternate embodiment of the present invention, the second signal may further (or alternatively) correspond to a bell sound (e.g., a single strike bell ring command).

It should be appreciated that the present invention is not limited to any particular type of user control, and includes all wireless controls (e.g., remote controls) and wired controls generally known to those skilled in the art. It should also be appreciated that the present invention is not limited to a user control that includes three predetermined positions. For example, a user control that includes two or ten predetermined positions is within the spirit and scope of the present invention.

Referring back to FIG. 1, the bell controller 170 is configured to receive the bell signal. For example, the bell signal may be provided to the bell controller 170, or intercepted by the bell controller 170 (e.g., intercepting a bell signal that is being provided to the sound subsystem). The bell controller 170 then uses the bell signal to control at least the bell device 180.

Figure 2:
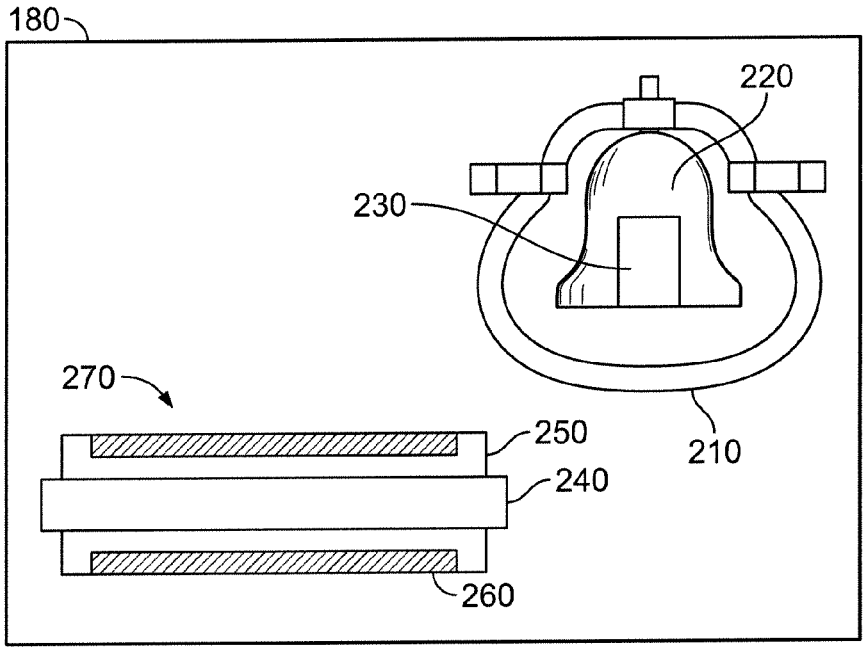
FIG. 2 illustrates one embodiment of the bell device depicted in FIG. 1, the embodiment comprising at least an electromagnetic device and a bell.

FIG. 2 illustrates a bell device in accordance with one embodiment of the present invention. Specifically, the bell device 180 includes a bell 220 and an electromagnetic device 270, wherein the bell 220 comprises a permanent magnet 230 and is configured to swing from a bracket 210, or a pivoting portion thereof. The electromagnetic device 270 may include a spool 250, a core 240 and a coil 260, wherein the core 240 is at least partially disposed inside the spool 250, and the coil 260 is wrapped at least partially around the spool 250. In a preferred embodiment of the present invention, the spool 250 is constructed using a non-conductive material (e.g., plastic), the coil 260 is constructed using a conductive material (e.g., copper), and the core 240 is constructed using a metallic material (e.g., iron). By applying a voltage to the coil 260, and placing the core 240 near the permanent magnet 230, a magnetic field can be created around the core 240 and used to swing the magnet 230, and therefore the bell 220, from the bracket 210, or a pivoting portion thereof.

Figure 2A:
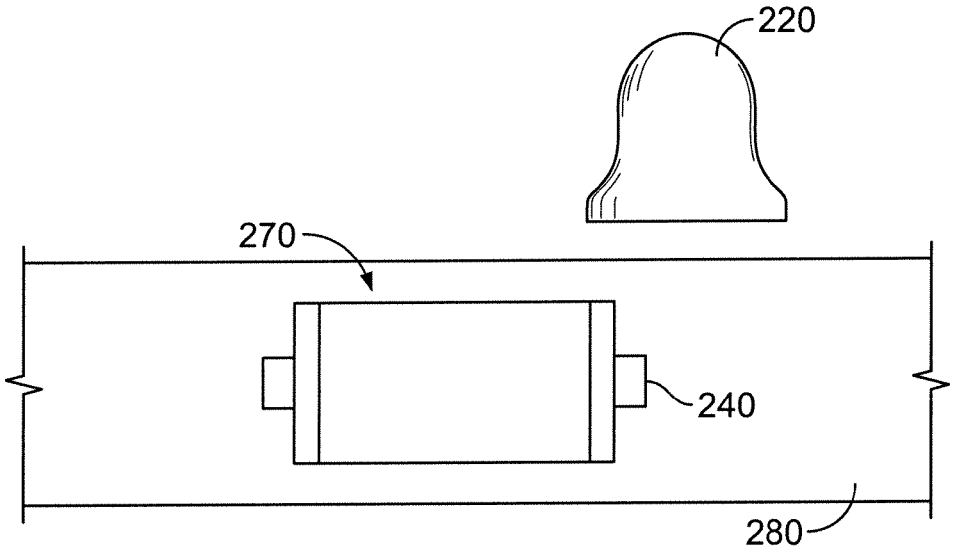
FIG. 2A illustrates, in accordance with one embodiment of the present invention, a first proximity between the electromagnetic device and the bell depicted in FIG. 2.
Figure 2B:
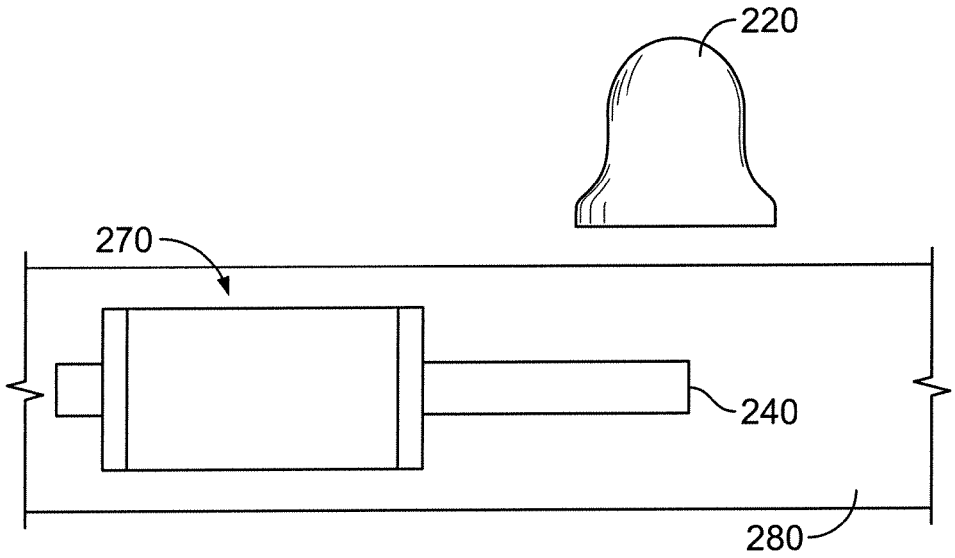
FIG. 2B illustrates, in accordance with another embodiment of the present invention, a second proximity between the electromagnetic device and the bell depicted in FIG. 2.

For example, as shown in FIG. 2A, the electromagnetic device 270 may be mounted inside a model vehicle 280 (e.g., a model train engine, a model train car, etc.), and the bell 220 may be mounted outside the model vehicle 280, but in close proximity to the electromagnetic device 270. By way of another example, as shown in FIG. 2B, the electromagnetic magnetic device 270 may be mounted inside the model vehicle 280, and the bell 220 may be mounted outside the model vehicle 280, but in close proximity to the core 240. The embodiment depicted in FIG. 2B is advantageous in that it allows the coil 260 and/or spool 250 to mounted in a more convenient location (e.g., further from the surface of the model vehicle 280, and therefore further from the bell 220).

Figure 3A:
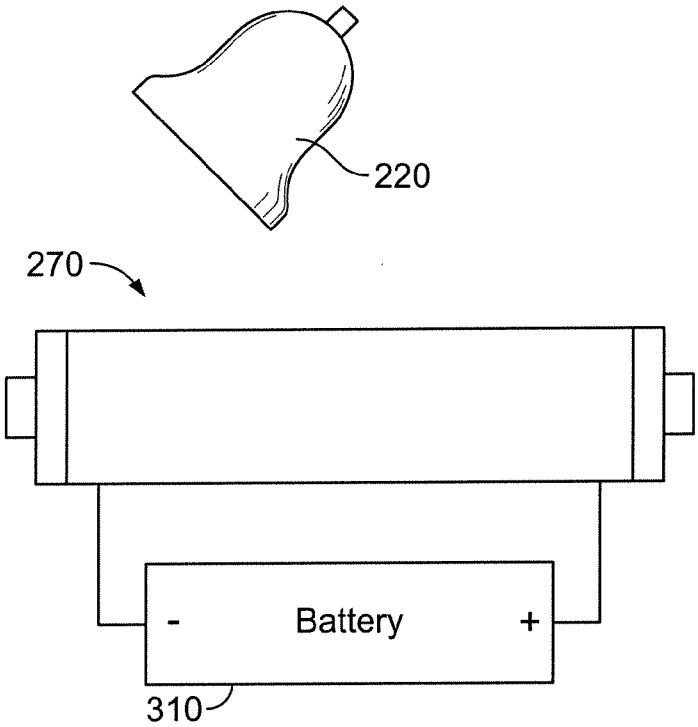
FIG. 3A illustrates, in accordance with one embodiment of the present invention, a first movement of the bell in response to a voltage being applied to the electromagnetic device.
Figure 3B:
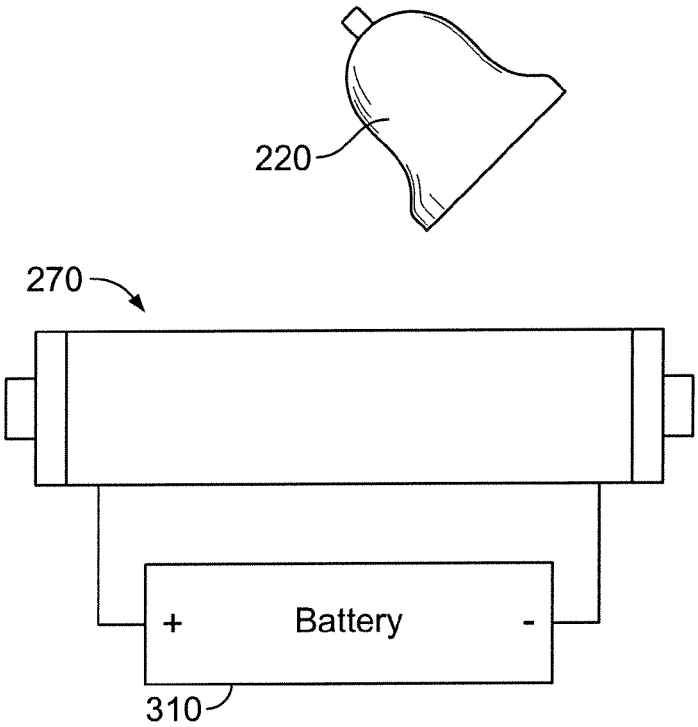
FIG. 3B illustrates, in accordance with another embodiment of the present invention, a second movement of the bell in response to a voltage being applied to the electromagnetic device.

By applying a particular voltage to the coil 260, a corresponding magnetic field can be created around the core 240 and used to move the bell 220 (a) in a particular direction and (b) a particular distance (or angle) from normal. For example, as shown in FIGS. 3A and 3B, by applying a first (e.g., positive) voltage to the coil 260, the bell 220 can be moved to the left, and by applying a second (e.g., negative) voltage to the coil 260, the bell 220 can be moved to the right. The distance the bell 200 moves (or its angle from normal) is determined by the magnitude of the voltage. For example, five volts may move the bell 45° from normal, whereas two volts may move the bell 20° from normal.

By way of example, a user may interact with the user control 100 to produce a bell signal corresponding to a bell angle of 45° from normal. The bell controller 170 may then use the bell signal to move the bell to an initial starting position of 45° from normal. This may be done, for example, by applying a particular voltage (having a particular polarity and a particular magnitude) to the electromagnetic device depicted in FIG. 2. By alternating the polarity of the voltage, and gradually reducing the magnitude of the voltage, actual bell movement can be simulated. In a real locomotive, a bell may include a rope, wherein the rope is pulled (e.g., by an engineer) to move the bell to an initial starting position. Once the rope is released, the bell may swing from side to side, in a decaying fashion. It is this movement that can be simulated by providing voltages with alternating polarities and reduced magnitudes.

It should be appreciated that the present invention is not limited to any particular type of bell device. For example, a bell that includes at least one magnet (e.g., permanent magnet, temporary magnet, electromagnetic device), or is constructed using at least one magnet, is within the spirit and scope of the present invention. It should also be appreciated that if the bell includes a magnet (e.g., a magnet is mounted inside the bell), then it may be advantageous to construct the bell, the bracket and/or a housing for the model vehicle using non-magnetic materials. It should further be appreciated that the present invention is not limited to the electromagnetic device depicted in FIG. 2, and may include any device(s) that is capable of producing a magnetic field. For example, a bell device that includes more than one electromagnetic devices (e.g., creating a push/pull effect) is within the spirit and scope of the present invention.

Figure 4:
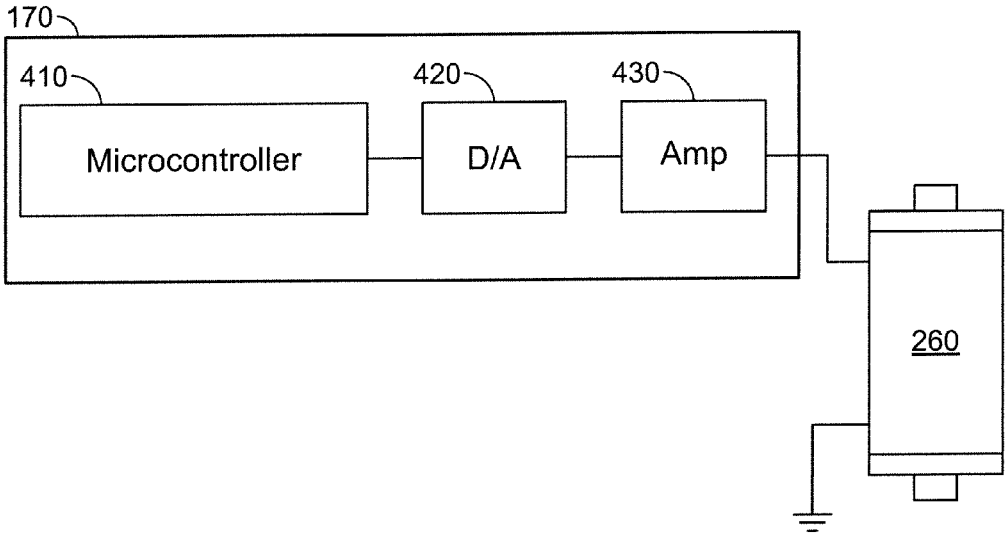
FIG. 4 illustrates one embodiment of the bell controller depicted in FIG. 1, the embodiment comprising at least a microcontroller, a converter and an amplifier.

FIG. 4 illustrates a bell controller in accordance with one embodiment of the present invention. Specifically, the bell controller 170 includes a microcontroller 410, a converter 420 (e.g., digital-to-analog converter), and an amplifier 430 in communication with the electromagnetic device. The microcontroller 410 is configured to receive the bell signal (e.g., from the user control), and to produce a digital signal in response thereto. The converter 420 is then configured to convert the digital signal into an analog signal, and the amplifier 430 is configured to convert (or amplify) the analog signal into a bell movement signal. In a preferred embodiment of the present invention, the bell movement signal comprises at least one voltage, which is provided to the coil 260 of the electromagnetic device, and used to produce at least one magnetic field.

Figure 5:
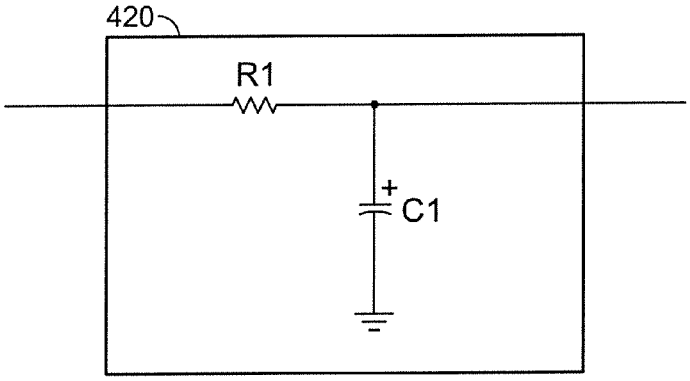
FIG. 5 illustrates one embodiment of the converter depicted in FIG. 4, the embodiment comprising at least an RC filter.

It should be appreciated that the present invention is not limited to any particular type of bell controller. For example, the bell controller may include a microprocessor, a processor, an application-specific IC (ASIC), or any other analog or digital circuit generally known to those skilled in the art. For example, a bell signal could be provided to a signal detector (e.g., a flip-flop circuit, etc.) that switches on/off an oscillator (e.g., op amps, 555-style timer), which (via an amplifier) creates an analog signal. Further, the bell controller does not require any particular type of converter. For example, as shown in FIG. 5, the converter 420 may include a simple RC filter (or an averaging filter), comprising at least one resistor R1 and at least one capacitor C1. Such a filter may be used to convert a pulse (e.g., defining a duty cycle) into an analog signal.

Figure 6:
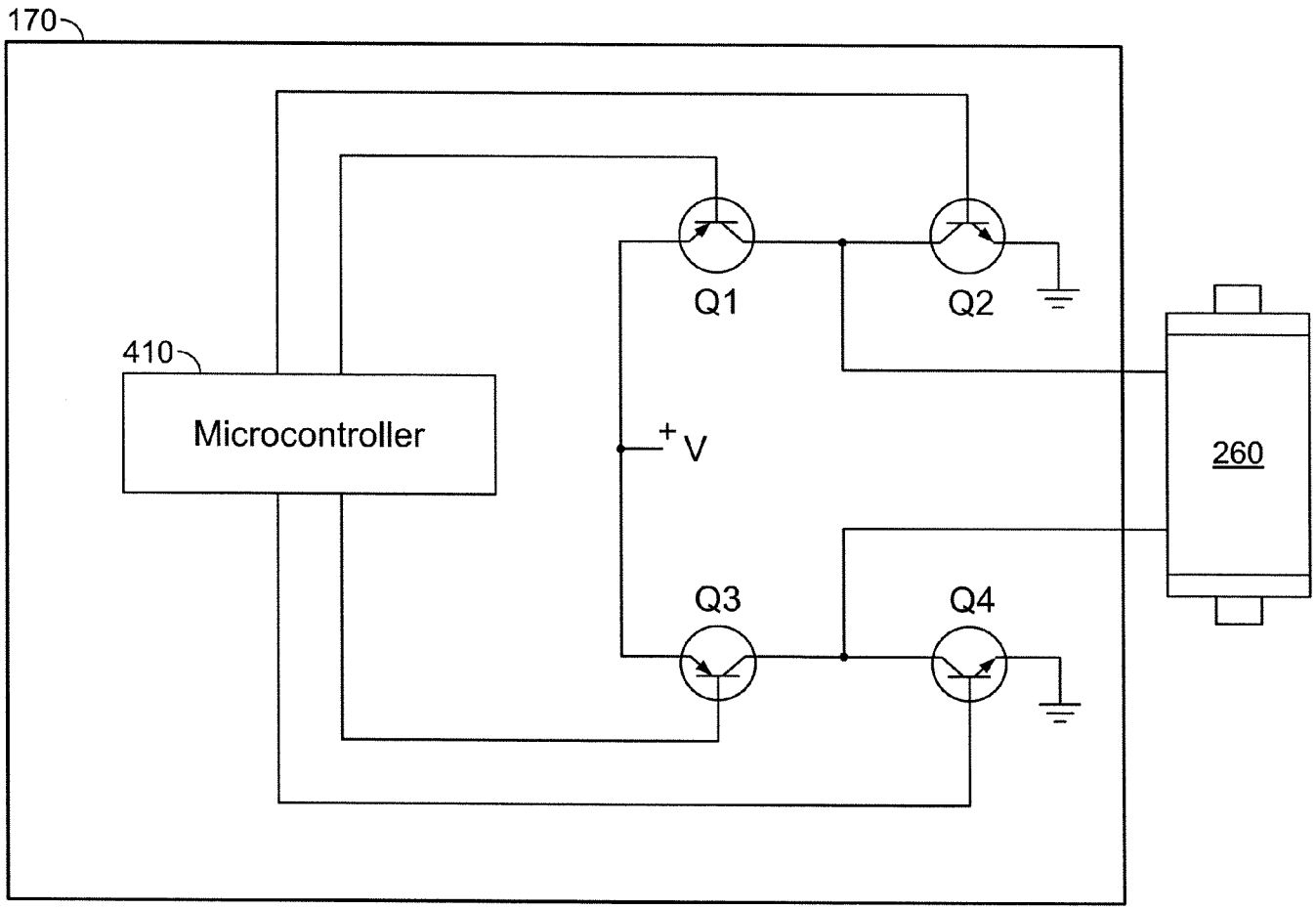
FIG. 6 illustrates another embodiment of the bell controller depicted in FIG. 1, the embodiment comprising at least a microcontroller and a plurality of switching devices.

In an alternate embodiment of the present invention, as shown in FIG. 6, the bell controller 170 includes a microcontroller 410 (or a variant thereof) and a plurality of switching devices (e.g., Q1-Q4). By controlling each switching device (e.g., Q1-Q4), the microcontroller 410 can provide a bell movement signal (e.g., at least one voltage) to the coil 260 of the electromagnetic device. For example, by driving first and fourth switching devices Q1, Q4, a positive voltage can be applied to the electromagnetic device, and by driving second and third switching devices Q2, Q3, a negative voltage can be applied to the electromagnetic device. The magnitude of the voltages can be controlled using pulse width modulation; a technique generally known to those skilled in the art.

It should be appreciated that this embodiment of the present invention is not limited to a particular type of switching device, and may include, for example, bipolar junction transistors, field-effect transistors, and/or all switching devices generally known to those skilled in the art. It should further be appreciated that this embodiment of the present invention is not limited to the number or type of components depicted in FIG. 6. For example, a bell controller that includes additional or fewer switching devices or additional components (e.g., an amplifier between the switching devices and the electromagnetic device) is within the spirit and scope of the present invention.

In one embodiment of the present invention, the bell controller is further configured to synchronize bell movement with bell sound. For example, in a first embodiment of the present invention, the sound subsystem 160 is configured to receive the bell signal from the user control 100, and to produce a bell sound in response thereto. The bell controller 170 is then configured to transmit the bell movement signal (e.g., at least one voltage) at a particular time, so as to substantially synchronize at least one bell movement with at least one bell sound.

In an alternate embodiment of the present invention, the sound subsystem 160 is configured to receive a bell sound signal (e.g., a single strike bell ring command) from the bell controller 170, and to produce a bell sound in response thereto. The bell controller 170 is configured to transmit the bell sound signal at a particular time, so as to substantially synchronize at least one bell movement with at least one bell sound. For example, the bell controller 170 may be configured to transmit the bell movement signal and the bell sound signal at substantially the same time, so as to substantially synchronize a particular bell movement with a particular bell sound. Further, the bell controller 170 may be configured to transmit a bell sound signal that corresponds (e.g., in volume, pitch, etc.) to the veracity with which the bell 220 is being swung. For example, if the bell is swung gently, then the bell controller may transmit a "soft" bell sound signal. However, if the bell is swung with force, then the bell controller may transmit a "loud" bell sound signal.

It should be appreciated that the present invention is not limited to any particular type of sound subsystem. For example, a sound subsystem that includes a memory (e.g., for storing digital sounds), a controller (e.g., for receiving a sound command, retrieving a corresponding digital sound from the memory, transmitting the digital sound), an A/D converter (e.g., for converting the digital sound into an analog sound), an amplifier (e.g., for amplifying the analog sound) and/or a speaker (e.g., for playing the amplified analog sound), is within the spirit and scope of the present invention.

Having thus described several embodiments of a system and method for controlling bell movement and/or sound in a model vehicle, it should be apparent to those skilled in the art that certain advantages of the system and method have been achieved. It should also be appreciated that various modifications, adaptations, and alternative embodiments thereof may be made within the scope and spirit of the present invention. For example, regardless of what position the lever has been moved to (e.g., 25°, 45°, continuous, etc.), the bell controller may be configured to vary the manner in which the bell is swung. For example, in response to a bell signal for continuous bell movement, the bell controller may be configured to vary control (or swing) of the bell (e.g., time, speed, veracity, etc.) randomly or in accordance with preprogrammed information. The invention is solely defined by the following claims.

What is claimed is:

1. A model vehicle system, comprising:

a user control configured to transmit at least one bell signal in response to a user interacting with said user control;

a bell device comprising an electromagnetic device and a bell connected to a pivot, wherein at least a portion of said bell comprises a magnet; and a bell controller configured to receive said at least one bell signal from said user control, and to produce in response thereto a bell movement signal;

wherein said electromagnetic device is configured to receive said bell movement signal from said bell controller and to produce in response thereto a magnetic field, said magnetic field being used to physically swing said bell from said pivot.

2. The system of claim 1, wherein a polarity of said magnetic field controls a direction in which said bell is swung, and a magnitude of said magnetic field controls a distance from normal in which said bell is swung.

3. The system of claim 1, wherein said user control comprises a spring loaded lever and said user interaction comprises sliding said lever to one of a plurality of predetermined positions, said one of said plurality of predetermined positions corresponding to a starting angle of said bell on said pivot.

4. The system of claim 2, wherein said user interaction further comprises releasing said lever from said one of said plurality of predetermined positions, wherein said release triggers a transmission of a second one of said at least one bell signal, said second one of said at least one bell signal corresponding to a release of said bell from said starting angle.

5. The system of claim 1, wherein said user control comprises a lever and said user interaction comprises moving said lever to at least one position, said at least one position including a first position corresponding to continuous movement of said bell on said pivot.

6. The system of claim 1, wherein said bell movement signal comprises at least one voltage, and said electromagnetic device comprises a spool, a core at least partially inside said spool, and a coil wrapped at least partially around said spool, said core being configured to produce said magnetic field in response to said at least one voltage being applied to said coil.

7. The system of claim 1, wherein said bell further comprises an outer shell, said magnet is positioned inside said outer shell, and said outer shell and said pivot comprises a material that is non-magnetic.

8. The system of claim 1, further comprising a sound subsystem configured to receive said at least one bell signal and to produce in response thereto a bell sound.

9. The system of claim 1, further comprising a sound subsystem configured to receive a bell sound signal and to produce in response thereto a bell sound, said bell controller being further configured to transmit said bell sound signal to said sound subsystem at a particular time so as to synchronize said bell sound with movement of said bell on said pivot.

10. The system of claim 1, wherein said bell controller further comprises a microcontroller, a digital-to-analog (D/A) converter and an amplifier, wherein said microcontroller is configured to receive said at least one bell signal from said user control, and to produce in response thereto a digital signal that corresponds to said bell movement signal, said D/A converter converting said digital signal into an analog signal, and said amplifier using said analog signal to produce said bell movement signal.

11. The system of claim 1, wherein said bell controller further comprises a microcontroller, an averaging filter and an amplifier, wherein said microcontroller is configured to receive said at least one bell signal from said user control, and to produce in response there to a duty cycle that corresponds to said bell movement signal, said averaging filter converting said duty cycle into an analog signal, and said amplifier using said analog signal to produce said bell movement signal.

12. The system of claim 1, wherein said bell controller further comprises a microcontroller and a plurality of switching elements, wherein said microcontroller is configured to receive said at least one bell signal from said user control, and to produce in response thereto said bell movement signal by controlling individual ones of said plurality of said switching elements.

13. A method for controlling a bell on a model vehicle, comprising:

interacting with a user control;

transmitting in response to said interacting step a bell signal from said user control and to said model vehicle;

using said bell signal to produce a bell movement signal;

transmitting said bell movement signal to an electromagnetic device; and using said bell movement signal to produce a magnetic field;

wherein at least a portion of a bell comprises a permanent magnet, a polarity of said magnetic field is used to swing said bell in a particular direction, and a magnitude of said magnetic field is used to swing said bell a particular distance from normal.

14. The method of claim 13, wherein said step of interacting with a user control further comprises moving a spring loaded lever to one of a plurality of predetermined positions, said one of said plurality of predetermined positions corresponding to a starting angle from which said bell is initially swung.

15. The method of claim 14, wherein said step of interacting with a user control further comprises releasing said lever from said one of said plurality of predetermined positions, wherein said release triggers said step of transmitting at least a portion of said bell signal, said at least a portion of said bell signal corresponding to at least one of said starting angle and a release of said bell from said starting angle.

16. The method of claim 13, wherein said step of interacting with a user control further comprises moving a lever to at least one position, said at least one position including a first position corresponding to continuous swinging of said bell.

17. The method of claim 13, wherein said steps of using said bell signal to produce a bell movement signal, and using said bell movement signal to produce a magnetic field, further comprises using said bell signal to produce at least one voltage, and applying said at least one voltage to a coil to produce said magnetic field around a core, said core being at least partially disposed inside said coil.

18. The method of claim 13, further comprising the steps of (1) transmitting a bell sound signal to a sound subsystem, wherein said sound subsystem uses said bell sound signal to produce a bell sound, and (2) substantially synchronizing said transmission of said bell sound signal with said transmission of said bell movement signal.

19. A model vehicle system, comprising:

a remote control configured to transmit a bell signal in response to a user interacting with said remote control;

a bell device comprising an electromagnetic device, a bell and a mounting bracket for said bell, wherein said electromagnetic device comprises a core and a coil, and said bell comprises an outer shell and a magnet; and a bell controller configured to receive said bell signal from said remote control, and to produce in response thereto at least one voltage;

wherein said at least one voltage is applied to said coil, thereby producing a magnetic field around said core, a polarity of said magnetic field being used to swing said bell from said mounting bracket in a particular direction, and a magnitude of said magnetic field being used to swing said bell a particular distance from normal.

20. The system of claim 19, further comprising a sound subsystem configured to receive a bell sound signal and to produce in response thereto a bell sound, said bell controller being further configured to transmit said bell sound signal to said sound subsystem so as to synchronize said bell sound with movement of said bell on said mounting bracket.

* * * * *